United States Patent [19]

Morin

[11] Patent Number: 4,860,389

[45] Date of Patent: Aug. 29, 1989

[54] PROTECTIVE HELMET WITH MOVABLE INTEGRATED SCREEN

[75] Inventor: Claude Morin, Peymeinade, France

[73] Assignee: T.A.C. (Tongerese Automaten Centrale), Tongeren, Belgium

[21] Appl. No.: 178,968

[22] Filed: Apr. 7, 1988

[30] Foreign Application Priority Data

Apr. 17, 1987 [BE] Belgium ..... 08700424

[51] Int. Cl.[4] ..... A42B 3/02

[52] U.S. Cl. ..... 2/424

[58] Field of Search ..... 2/6, 8, 9, 424, 425, 2/427, 429

[56] References Cited

U.S. PATENT DOCUMENTS

| | | | |
|---|---|---|---|
| 2,190,074 | 2/1940 | Locher | 2/8 |
| 4,312,078 | 1/1982 | Pollitt et al. | 2/424 |
| 4,524,465 | 6/1985 | Huber | 2/424 |
| 4,615,052 | 10/1986 | Nava | 2/424 |
| 4,748,696 | 6/1988 | Fohl | 2/424 |

FOREIGN PATENT DOCUMENTS

| | | | |
|---|---|---|---|
| 1048673 | 1/1959 | Fed. Rep. of Germany | 2/8 |
| 224215 | 7/1985 | German Democratic Rep. | 2/8 |

*Primary Examiner*—Wm. Carter Reynolds

*Attorney, Agent, or Firm*—Cushman, Darby & Cushman

[57] ABSTRACT

A helmet of the integral type (1) including a helmet (2) provided with an aperture (3) closable by means of a movable screen (4). The movable screen is removed from the aperture by a pushbutton (7) actuating a lever (8). The lever is accommodated by the thickness of the helmet itself and bears on the inner face of the screen. In order to move the screen relative to the helmet, the end of a finger is placed between the helmet and the screen and manually opens aperture (3).

9 Claims, 2 Drawing Sheets

PROTECTIVE HELMET WITH MOVABLE INTEGRATED SCREEN

The subject of the present invention is a protective helmet for drivers or passengers of vehicles, of the "integral" type, comprising a rigid impact-resistant helmet intended for protecting the forehead, the crown of the skull, the temples, the back of the skull, the nape and the chin and having an aperture exposing the part of the face containing the eyes and nose, a movable transparent screen, means for fastening, articulating and controlling this screen on the helmet, which are designed so that the said screen can assume two end positions, namely a first position in which it closes off the above-mentioned aperture and a second position in which it opens this aperture at least partially, and a chin strap connected to the helmet in order to secure the latter and prevent it from being torn off in the event of an impact.

Different embodiments of a helmet of the above-mentioned type are already known. In a first embodiment which is the simplest, the screen is laid over some of its periphery against the outer face of the helmet in order to close off the abovementioned aperture Here, there is no true integration of the screen with the helmet, and in order to open the aperture it can be operated by acting with the finger or fingers on the edge of the screen projecting relative to the aperture. Although this embodiment is simple, it nevertheless has various disadvantages, namely the inflow of air into the helmet through the gap between the screen and the helmet, aerodynamic noises caused by the screen edges projecting relative to the helmet, and the danger that the screen will be caught on the projecting edges in the event of a fall. To overcome these disadvantages, one idea was to integrate the screen completely in the aforesaid aperture in order to eliminate the abovementioned projecting edges. In this embodiment, a cavity was made in the helmet along the lower edge of the screen, this cavity communicating with the helmet aperture and the finger being insertable via this in order to control the screen, this still having the disadvantage of allowing disturbing inflows of air into the helmet via the abovementioned cavity and generating aerodynamic noises in the region of this cavity. To overcome these last disadvantages, the idea, in an integral screen, was to eliminate the aforesaid cavity and control the movements of the said screen by means of mechanisms composed of levers and springs, of cables controlled by pulls and wheels arranged at the base of and inside the helmet. The disadvantage of this last helmet embodiment is that it makes use of complex and delicate mechanisms which, in the event of a fall, on the one hand can be damaged and jammed and on the other hand can shift inside the helmet and injure the user. Moreover, these mechanisms are difficult to control.

The object of the invention is to overcome the various disadvantages mentioned above and provide a helmet with a completely integral screen which is mounted on the helmet by means of an especially simple mechanism employing an extremely small number of movable components made of semi-rigid material and in which the opening of the helmet aperture is actuated by means of a simple control accessible perfectly easily from outside the helmet.

To achieve this, according to the invention, the helmet aperture and the screen are matched so that, when the latter occupies its first end position mentioned above, the screen is integrated into the helmet so that its outer face and that of the helmet are joined virtually without a gap or difference in level, the means for fastening, articulating and controlling the screen comprising a pushbutton mounted on the helmet so as to be accessible from outside the latter, and a lever associated with the said pushbutton and accommodated in the thickness of the helmet and bearing on the inner face of the screen in order to make it possible to bring the latter, under the action of the pushbutton, from its aforesaid first end position into an intermediate position, in which the screen is released from the helmet aperture and in which it is possible to place the end of at least one finger between the helmet and the screen so as to bring it manually into its second end position.

According to one embodiment of the invention, the pushbutton is arranged in a receptacle provided in the helmet from the end face of the latter, the cross-section of the pushbutton and the cross-section of the receptacle, which are taken perpendicularly relative to the direction of movement of the pushbutton, being substantial equal so as to reduce to a minimum the gap persisting between the side walls of the pushbutton and the corresponding walls of the receptacle, the visible face of the pushbutton being profiled in such a way that, when the pushbutton is in the position of rest, it is adjoined to the outer face of the helmet without a difference in level.

According to an advantageous embodiment of the invention, the abovementioned receptacle, in which the pushbutton is arranged, communicates along one of its edges with the helmet aperture, so that, when the pushbutton is actuated by means of the end of the finger, especially the thumb, the latter can be slipped via the receptacle into the aforesaid aperture in order, when the screen occupies its abovementioned intermediate position, to make contact with the edge and the inner face of the screen so as to bring it manually into its second end position.

According to an especially advantageous embodiment of the invention, the means for fastening and articulating the screen to the helmet comprise a piece of generally quadrangular shape fastened to the screen along one of its sides, near each of the lateral edges of the screen, so as to have, relative to the screen, an extension intended to be arranged in a corresponding receptacle of the helmet partially when the screen occupies its second end position and completely when the screen occupies its first end position, this extension possessing, on the one hand, along the sides of the piece which adjoin the side fastened to the screen, two ramps each interacting with a fixed peg carried by the helmet and, on the other hand, a recess which is formed between the ramps and in which is seated the fixed peg carried by the helmet and interacting with the edges of the recess, these pegs are located at the vertices of a triangle, and the ramps and the recess are profiled to ensure that the screen, when it leaves its first end position in order assume its second end position, can execute a slight translational movement releasing the screen from the aperture, in which it is integrated, and moving it away from the helmet, this being followed by a rotational movement of the screen relative to the said helmet away from the latter, the movement of the screen in order to close off the aperture taking place in the same way in the opposite direction.

Other details and particular features of the invention will emerge from the description of the drawings which accompany this specification and which illustrate a particular embodiment of the helmet according to the invention by way of non-limiting example.

Figure 4:
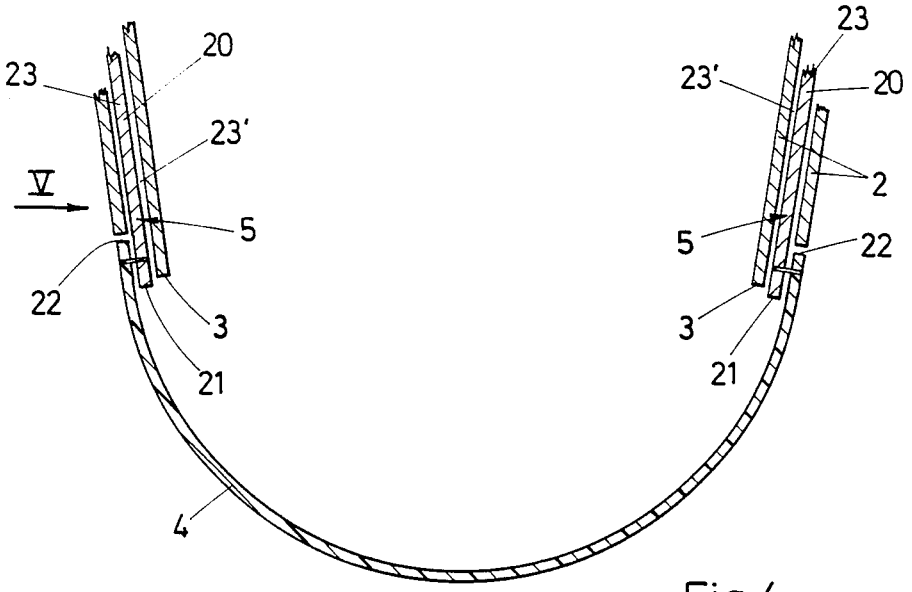
FIG. 4 is a partial diagrammatic cross-section along the line IV—IV of FIG. 1, illustrating the mode of fastening of the screen to the helmet.
Figure 5:
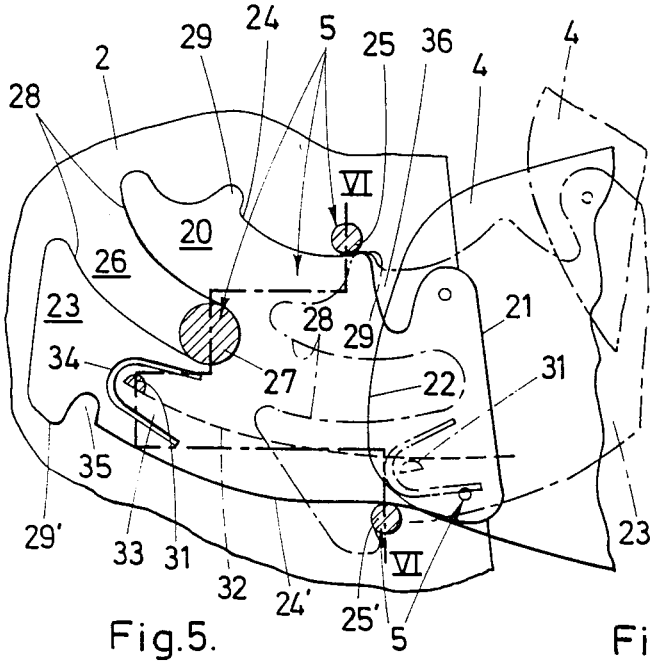

FIG. 5 is a view with partial breaks and according to the arrow V of FIG. 4, showing details of the means for fastening and articulating the screen to the helmet, the elements being represented by unbroken lines in the position which they occupy when the screen is in its first end position and by broken lines in the position which they occupy when the screen has been brought into its second end position and being tilted to make it possible to remove it from the helmet in order to replace it.

Figure 6:
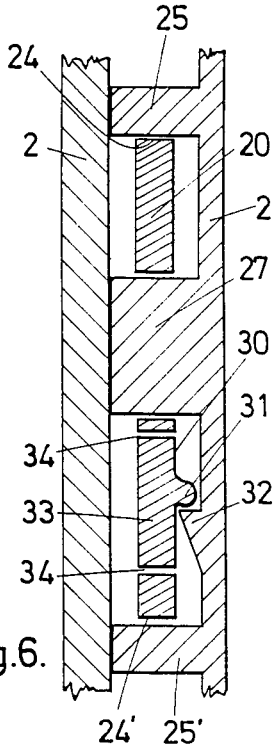

FIG. 6 is a cross-section on a large scale and along the line VI—VI of FIG. 5.

In the various figures, the same reference symbols denote identical elements.

Figure 1:
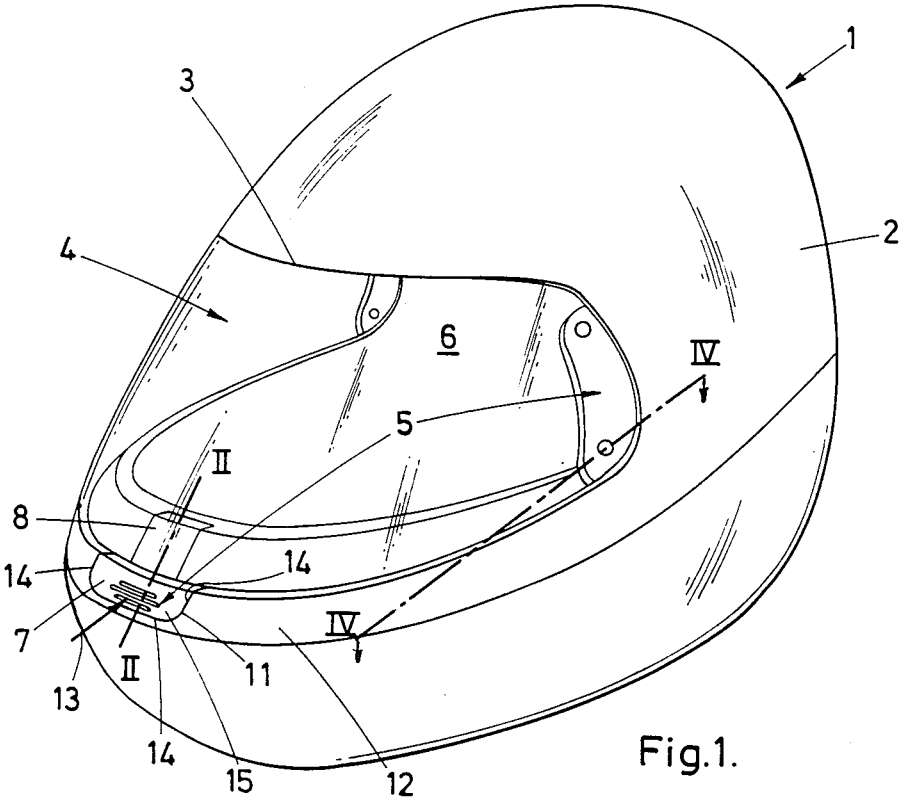
FIG. 1 is a perspective view showing the helmet according to the invention, with its screen in the position closing the helmet aperture.

The protective helmet 1 according to the invention, illustrated in the drawings, is of the "integral" type comprising a rigid impact-resistant helmet 2 intended for protecting the forehead, the crown of the skull, the temples, the back of the skull, the nape and the chin and having an aperture 3 exposing the part of the face containing the eyes and nose, a movable transparent screen 4, means 5 for fastening, articulating and controlling this screen on the helmet 2, which are designed so that the said screen 4 can assume two end positions, namely a first position, as shown in FIG. 1, in which it closes off the aperture 3, and a second position, in which it opens this aperture at least partially, and a chin strap (not shown) connected to the helmet 2 in order to secure the latter and prevent it from being torn off in the event of an impact. To avoid all projecting edges, disturbing inflows of air into the helmet and aerodynamic noises, the aperture 3 in the helmet 2 and the screen 4 are matched so that, when the latter occupies its first end position, the screen 4 is integrated into the helmet so that its outer face 6 and that of the helmet are adjoined virtually without a gap or difference in level. The means 5 for fastening, articulating and controlling the screen comprise a pushbutton 7 mounted on the helmet 2 so as to be accessible from outside the latter (see FIGS. 1 to 3), and a lever 8 associated with this pushbutton and accommodated in the thickness of the helmet and bearing on the inner face 9 of the screen 4 in order to make it possible to bring it, under the action of the pushbutton 7, from its aforesaid first end position into an intermediate position, shown in FIG. 3, in which the screen is released from the helmet aperture 2 and in which it is possible to place the end of a finger 10 between the helmet 2 and the screen 4 so as to bring it manually from its intermediate position, shown in FIG. 3, into its second end position opening the helmet aperture 9. To prevent disturbing inflows of air into the helmet and aerodynamic noises in the region of the pushbutton 7, the latter is arranged in a receptacle 11 provided in the helmet from the outer face 12 of the latter. The cross-section of this receptacle 11 and that of the pushbutton 7, which are taken perpendicularly relative to the direction of movement of the pushbutton indicated by the arrow 13, are substantially equal so as to reduce to a minimum the gap persisting between the side walls 14 of the pushbutton and the corresponding walls of the receptacle, the visible face 14 of the pushbutton being profiled in such a way that, when the pushbutton is in the position of rest (see FIGS. 1 and 2), it is adjoined perfectly to the outer face 12 of the helmet 2 without any difference in level. To make it easier to control the screen 4 manually from its aforesaid intermediate position, the receptacle 11, in which the pushbutton 7 is arranged, communicates along one of its edges with the helmet aperture 3, so that, when the pushbutton 7 is actuated by means of the end of the finger 10, especially by means of the thumb, the latter can be slipped through the receptacle 11 into the aperture 3 of the helmet 2 (FIG. 3) in order, when the screen 4 occupies its abovementioned intermediate position, to make contact with the edge 16 and the inner face 9 of the screen so as to bring it manually into its second end position. So that the action of the finger 10 is distributed uniformly, via the screen, over the means 5 for fastening and articulating the latter, the pushbutton 7 and the lever 8 associated with it are advantageously mounted in the helmet 2 near the base of the screen 4 and symmetrically relative to the plane of symmetry of the helmet perpendicular relative to a straight line passing through the ears.

Figure 2:
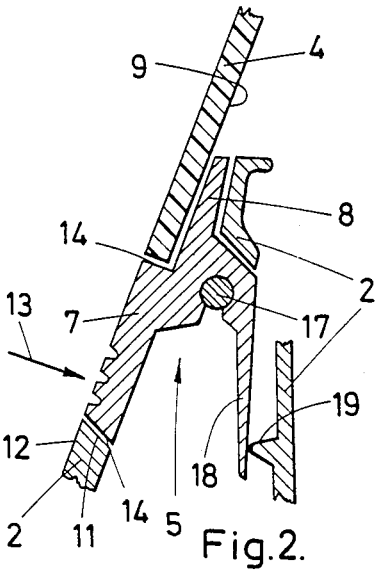
FIG. 2 is a partial cross-section along the line II—II of FIG. 1, showing the means for controlling the screen which comprise the aforesaid pushbutton and lever, the pushbutton occupying its position of rest and the screen its aforesaid first end position.
Figure 3:
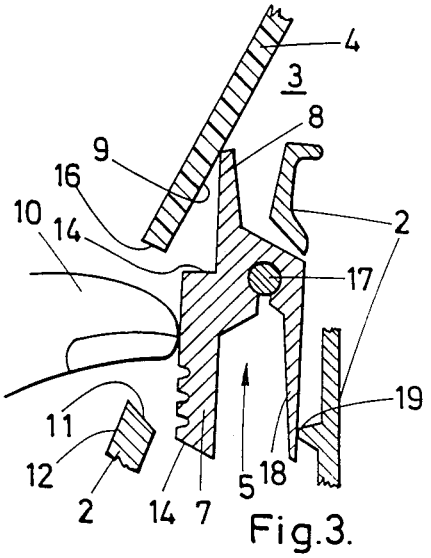
FIG. 3 is a view similar to that of FIG. 2, in which the pushbutton is shown in the position which it occupies when it has been actuated in order to bring the screen into its abovementioned intermediate position.

In order to simplify to an extreme degree the means 5 for controlling the screen 4, the pushbutton 7 and the lever 8 are advantageously made in one piece, as shown in FIGS. 2 and 3 and arranged substantially in the extension one of the other, this piece being mounted on a shaft 17 fastened to the helmet 2, so as to be freely rotatable about the latter counter to a tab 18 located on the piece and forming a spring, this tab bearing on an element 19 of the helmet 2.

As illustrated in FIGS. 4 and 6 and more particularly in FIG. 5, the means 5 for fastening and articulating the screen 4 to the helmet 2 comprise a piece 20 of generally quadrangular shape fastened to the screen along one of its sides 21, near each of the lateral edges 22 of the screen 4, so as to have, relative to the screen, an extension 23 intended to be arranged in a corresponding receptacle 23', made in the helmet 2, partially when the screen 4 occupies its second end position (opening of the aperture 3) and completely when it occupies its first end position (closing of the aperture 3). To guide the shifts of the piece 20 during the movements of the screen, this extension 23 possesses, on the one hand, along the sides of the piece 20 which adjoin the side 21 fastened to the screen, two ramps 24, 24' each interacting with a fixed peg 25, 25' carried by the helmet 2 and, on the other hand, a recess 26 which is formed between the ramps 24, 24' and in which is seated a fixed peg 27 carried by the helmet and interacting with the edges 28 of the recess. To prevent blockage or jamming during the movements of the pieces 20 in their receptacle 23' when the screen 4 is actuated, the pegs 25, 25' and 27 are advantageously located at the vertices of a triangle. The ramps 24 and 24' and the recess 26 are profiled to ensure that the screen, when it leaves its first end position in order to assume its second end position, can execute a slight translational movement releasing the screen from the aperture, in which it is integrated, and moving it away from the helmet, this being followed by a rotational movement of the screen relative to the said helmet away from the latter, to prevent any contact between the screen and the said helmet. The movement of the screen 4 in order to close off the aperture 3 takes place in the same way in the opposite direction.

To prevent extensions 23 of the pieces 20 from leaving the receptacles 23' when the screen is moved towards its second end position, the aforesaid ramps 24 and 24' each have (see FIG. 5) a stop 29, 29', against which the corresponding peg 25, 25' located on the helmet 2 comes to bear when the screen reaches its second end position.

To complete the guidance of the extensions 23 of the pieces 20 in their receptacle 23' made in the helmet 2, each of these extensions, in its part furthest away from the screen 4 and on its face 30 turned towards the inside of the helmet, has a stud 31 interacting with a fixed ramp 32 located on the helmet (see FIGS. 5 and 6). This ramp 32, like the ramps 24, 24' and the recess 26 of the extension 23, is profiled in order to ensure the abovementioned movement of the screen 4. The pieces 20 are advantageously made of a semi-rigid material, and each of the extensions 23 of these pieces has its stud 31 which is located in a deformable zone 33 of the said extension. This zone 33, which is made easily deformable as a result of the cutout 34 made in the extension 33, is accessible through the aperture 3 in the helmet 2 when the screen 4 occupies its second end position. Thus, a pressure exerted on this zone through a hole (not shown) made inside the helmet opposite the said zone makes it possible to release the stud 31 from the ramp 32, in order to make it possible to detach the pieces 20 for fastening the screen 4 from the helmet, for the purpose of replacing the screen. This detachment, which takes place as a result of the rotation of the extension 23 of each piece 20 about the peg 25' interacting with the ramp 24' formed along the lower edge of the extension, is made possible as a result of a notch 35 which is made in the aforesaid extension from its lower edge and at the front of the stop 29' and in which the peg 25' can fall when the screen occupies its second end position (opening of the helmet aperture). This notch 35 is formed in such a way that, when the peg 25' is seated in it, the extension 23 of each piece 20 is released from the other two pegs 25 and 27 with which it interacts. A new screen 4 equipped with its piece 20 is put in place in reverse direction and in the same way. The cutout 36 (FIG. 5) made in the pieces 20 is intended to give these greater elasticity which improves the movement of the extensions 23 of the pieces 20 in the receptacles 23' of the helmet 2.

It goes without saying that the invention is in no way limited to the embodiment described and that many modifications can be made to the latter, without departing from the scope of the present patent.

I claim:

1. A protective helmet (1) for drivers or passengers of vehicles, of the "integral" type, comprising a rigid impact-resistant helmet (2) intended for protecting the forehead, the crown of the skull, the temples, the back of the skull, the nape and the chin and having an aperture (3) exposing the part of the face containing the eyes and the nose, a movable transparent screen (4), means (5) for fastening, articulating and controlling this screen on the helmet (2), which are designed so that the said screen (4) can assume two end positions, namely a first position in which it closes off the aforesaid aperture (3) and a second position in which it opens this aperture at least partially, the said helmet being defined in that the aperture in the helmet (2) and the screen (4) are matched so that, when the latter occupies its abovementioned first end position, the screen (4) is integrated into the helmet (2) so that its outer face (6) and that of the helmet are adjoined virtually without a gap or a difference in level, the means (5) for fastening, articulating and controlling the screen comprising a pushbutton (7) mounted on the helmet (2) so as to be accessible from outside the latter, and a lever (8) associated with the said pushbutton (7) and accommodated in the thickness of the helmet (2) and bearing on the inner face (9) of the screen (4) in order to make it possible to bring the latter, under the action of the pushbutton (7), from its aforesaid first end position into an intermediate position, in which the screen (4) is released from the helmet aperture (3) and in which it is possible to place the end of at least one finger (10) between the helmet (2) and the screen (4) so as to bring it manually to its second end position.

2. A helmet as claimed in claim 1, wherein the pushbutton (7) is arranged in a receptacle (11) provided in the helmet from the end face (12) of the latter, the cross-section of the pushbutton and the cross-section of the receptacle, which are taken perpendicularly relative to the direction of movement of the pushbutton, being substantially equal so as to reduce to a minimum the gap persisting between the side walls (14) of the pushbutton (7) and the corresponding walls of the receptacle (11), the visible face (15) of the pushbutton being profiled in such a way that, when the pushbutton is in the position of rest, it is adjoined to the outer face (12) of the helmet (2) without a difference in level.

3. A helmet as claimed in claim 2, wherein the aforesaid receptacle (11), in which the pushbutton (7) is arranged, communicates along one of its edges with the helmet aperture (3), so that, when the pushbutton (7) is actuated by means of the end of the finger (10), especially the thumb, the latter can be slipped via the receptacle (11) into the aforesaid aperture (3) in order, when the screen (4) occupies its abovementioned intermediate position, to make contact with the edge (16) and the inner face (9) of the screen so as to bring it manually into its second end position.

4. A helmet as claimed in claim 1, wherein the pushbutton (7) and the lever (8) associated with it are mounted in the helmet (2) near the base of the screen (4) and symmetrically relative to the plane of symmetry of the helmet perpendicular relative to a straight line passing through the ears.

5. A helmet as claimed in claim 1, wherein the pushbutton (7) and the lever (8) are made in one piece and are arranged substantially in the extension one of the other, this piece being mounted on a shaft (17) fastened to the helmet (2) so as to be freely rotatable about the latter counter to a tab (18) located on the piece and forming a spring, this tab (18) bearing on an element (19) of the helmet.

6. A helmet as claimed in claim 1, wherein the means (5) for fastening and articulating the screen to the helmet comprise a piece (20) of generally quadrangular shape fastened to the screen along one of its sides (21), near each of the lateral edges (22) of the screen (4), so as to have, relative to the screen, an extension (23) intended to be arranged in a corresponding receptacle (23'), made in the helmet (2), partially when the screen (4) occupies its second end position and completely when the screen occupies its first end position, this extension (23) possessing, on the one hand, along the sides of the piece (20) which adjoin the side (21) fastened to the screen (4), an upper ramp (24) and a lower ramp (24') each interacting with a fixed peg (25, 25') carried by the helmet (2) and, on the other hand, a recess (26) which is formed between said ramps (24, 24') and in which is seated a fixed peg (27) carried by the helmet and interacting with the edges (28) of the recess, these pegs (25, 25' and 27) are located at the vertices of a triangle and the said ramps (24, 24') and the recess (26) are profiled to ensure that the screen (4) when it leaves its first end position in order to assume its second end position, can execute a slight translational movement releasing the screen from the aperture (3), in which it is integrated, and moving it away from the helmet (2) this being followed by a rotational movement of the screen relative to the said helmet away from the latter, the movement of the screen in order to close off the aperture taking place in the same way in the opposite direction.

7. A helmet as claimed in claim 6, wherein at least one of the aforesaid ramps (24, 24') has a stop (29, 29'), against which the corresponding peg (25, 25') comes to bear when the screen reaches its second end position.

8. A helmet as claimed in claim 6, wherein the extension (23) of the piece (20), in its part furthest away from the screen and on its face (30) turned towards the inside of the helmet, has a stud (31) interacting with a fixed ramp (32) located on the helmet (2), this ramp (32), like the ramps (24, 24') of the recess (26) of the extension, being profiled in order to ensure the abovementioned movement of the screen.

9. A helmet as claimed in claim 8, wherein the stud (31) carried by the extension (23) of the piece (20) is located in a deformable zone (33) of the said extension, this zone (33) being accessible through the aperture (3) in the helmet (2) when the screen (4) occupies its second end position, so that a pressure exerted on the said zone (33) through a hole made inside the helmet opposite the said zone makes it possible to release the stud (31) from the ramp (32), in order to make it possible to detach the pieces (20) for fastening the screen from the helmet, for the purpose of replacing the screen, this detachment, which takes place as a result of the rotation of the extension (23) of the piece (20) about the peg (25') interacting with said lower ramp (24') formed along the lower edge of the extension (23), being made possible as a result of a notch (35) which is made in the aforesaid extension (23) from its lower edge and at the front of the stop (29') in which the aforesaid peg (25') can fall, this notch (35) being formed in such a way that, when the peg (25') is seated in it, the extension (23) of the abovementioned piece (20) is released from the other two pegs (25 and 27) with which it interacts.

* * * * *